US005508683A

United States Patent [19]

Hall

[11] Patent Number: 5,508,683

[45] Date of Patent: Apr. 16, 1996

[54] WEAPON HANDGRIP SAFETY ALARM

[76] Inventor: James K. Hall, 1466 Chicago Blvd., Detroit, Mich. 48206

[21] Appl. No.: 344,945

[22] Filed: Nov. 25, 1994

[51] Int. Cl.[6] ..... G08B 13/14

[52] U.S. Cl. ..... 340/571; 340/689; 42/70.01

[58] Field of Search ..... 340/571, 686, 340/689, 652; 42/70.01, 1.01, 7

[56] References Cited

U.S. PATENT DOCUMENTS

| | | | |
|---|---|---|---|
| 3,530,451 | 9/1970 | Devine | 340/224 |
| 4,003,152 | 1/1977 | Barker | 42/70.01 |
| 4,327,360 | 4/1982 | Brown | 340/571 |
| 4,467,545 | 8/1984 | Shaw | 42/70.01 |
| 4,755,806 | 7/1988 | Villarreal | 340/689 |
| 4,768,021 | 8/1988 | Ferraro | 340/568 |
| 4,800,665 | 1/1989 | Schumaker | 42/70.01 |
| 5,108,019 | 4/1992 | Woodward et al. | 224/243 |
| 5,162,778 | 11/1992 | Williamson | 340/571 |
| 5,196,827 | 3/1993 | Allen et al. | 340/568 |
| 5,317,304 | 5/1994 | Choi | 340/571 |
| 5,321,390 | 6/1994 | Yuen | 340/571 |

*Primary Examiner*—Brent A. Swarthout
*Assistant Examiner*—Albert K. Wong
*Attorney, Agent, or Firm*—Barnes, Kisselle, Raisch, Choate, Whittemore & Hulbert

[57] ABSTRACT

A safety alarm for a weapon such as a hand gun is provided that is mounted in the hand grip of the weapon to warn of possible impending use by either an authorized or an unauthorized person. The safety alarm is mounted within the hand grip and has an alarm connected electronically to a battery in a normally open circuit that is closed only when a switch within the circuit is activated. In one embodiment the switch is in the form of a plunger that extends outside of the grip and is engaged by the hand to be depressed to connect two electronic contacts to complete the circuit and sound the alarm. In another embodiment the switch is in the form of a motion detector such as a mercury switch so that when the weapon is moved from one position in which the circuit is normally opened, the circuit is closed to connect the alarm to the battery and sound the alarm.

2 Claims, 2 Drawing Sheets

WEAPON HANDGRIP SAFETY ALARM

FIELD OF THE INVENTION

This invention relates to a safety device and more particularly to an alarm for a weapon to warn of unauthorized use.

BACKGROUND OF THE INVENTION

Increased occurrences in crime such as burglaries have led many people to possess weapons such as hand guns which are typically left in the home for protection. Unfortunately, an alarming rise of household accidents occurs when these loaded weapons are left unattended and are found by children who do not realize their deadly potential. It is often the case that even though an attempt is made to hide such weapons, children or other unauthorized persons find them and begin to play with the weapons. Parents who are unaware of the children's activities may not know that the weapons are being played with until the child harms him or herself or others, often times resulting in death.

Unfortunately, others possess guns with the intention of committing a crime. There have been increased reports of injury due to such weapons, some injuries which occur to persons such as police officers who are approaching an armed person. Many times the armed person may feel that he or she can fire the weapon before the police officer, who is usually armed, has time to draw his or her weapon.

SUMMARY OF THE INVENTION

A pistol grip safety alarm is provided comprising a weapon having a hand grip with a cavity therein. An alarm is mounted on the body in the cavity and is electrically connected to a battery similarly mounted on the body in the cavity. The alarm and battery are connected through an electric circuit having a normally open switch. The switch can be closed to complete the circuit and audibly sound the alarm to indicate intended use or to warn of unauthorized use of the weapon.

In one embodiment, the switch is in the form of a plunger button or actuator that extends from the cavity through the hand grip to be exposed to and engaged by the hand of the user to close the circuit and activate the alarm. The switch is normally left open. When a user grasps the hand grip, the switch is depressed to close the circuit and sound the alarm.

In another embodiment, the switch is in the form of a level switch that detects motion such as a mercury switch. The switch generally has a tube or container with a conductive liquid, such as mercury, located therein. The circuit is connected through separate contacts at each end of the tube. The weapon is normally placed so that the conductive liquid rests in substantially the center of the tube so as not to connect the electrical contacts and complete or close the circuit. When the weapon is moved, the conductive liquid flows to one end of the tube or the other to connect the contacts electrically and complete or close the circuit to audibly sound the alarm.

Objects, features and advantages of this invention include a safety device for a weapon that sounds an audible alarm to indicate possible impending use, that sounds an audible alarm to indicate unauthorized use, that is reliable, quick and easy to use, and of relatively simple design and economical manufacture.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
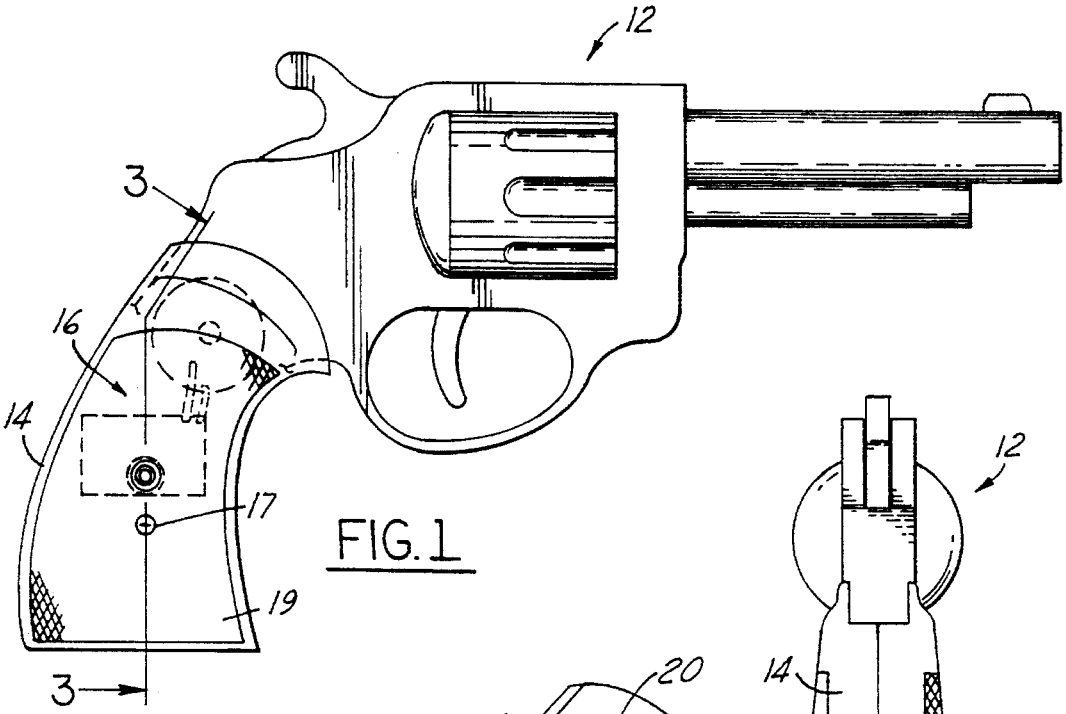
FIG. 1 is a side view of a weapon having a safety alarm embodying this invention.

FIG. 1 shows a weapon such as a hand gun 12 having a hand grip 14 which houses a safety alarm system 16. The safety alarm system 16 is housed within a cavity 18 within the hand grip 14 and is enclosed by a removable cover 19 normally secured by a fastener such as a screw 17.

Figure 4:
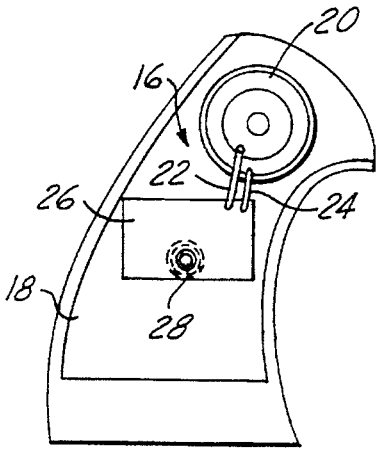
FIG. 4 is a side view of the hand of the weapon showing the safety device of this invention.
Figure 3:
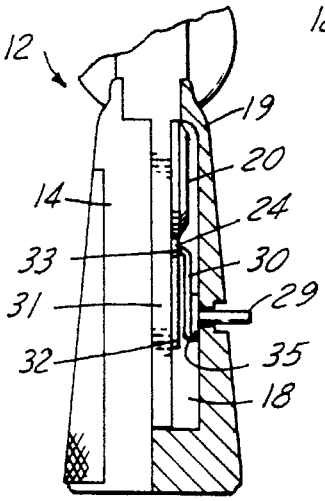
FIG. 3 is a partial cross-sectional rear view similar to FIG. 2 showing a safety device of the invention.

As seen most clearly in FIGS. 3 and 4, the safety alarm system 16 comprises an audible alarm 20 connected through wires 22 and 24 to an electric circuit 26 to activate and sound the audible alarm 20 through a switch 28.

Figure 2:
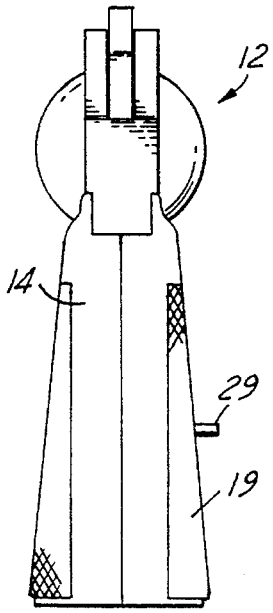
FIG. 2 is a rear view of the weapon of FIG. 1.

The switch shown in FIGS. 2 and 3 comprises normally open contacts 30 and 32 which, when closed, connect the alarm 20 to a battery 34 to sound the audible alarm. A plunger 29 serves as an actuator to close the switch contacts.

Figure 5:
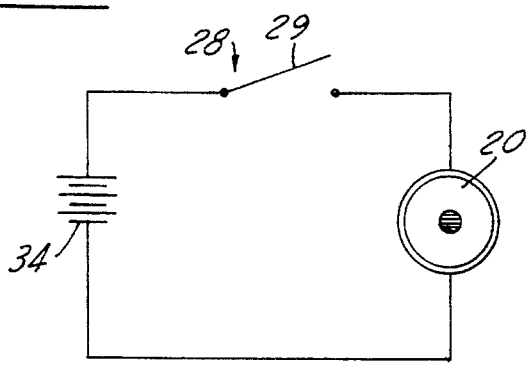
FIG. 5 is a schematic diagram of the electric circuit embodied in the safety device of this invention.

The contacts 30 and 32 are normally open. The contact 32 is secured to a wall 31 of the cavity 18. The contact 30 is preferably a bent leaf spring having one end 33 secured to the wall 31. The spring contact 30 in its natural, unstressed, free state condition shown in FIG. 3 has its other end portion 35 extending across contact 32 in spaced relation thereto. The plunger 29 is axially slidable in a passage 37 in cover 19. The inner end of the plunger is secured to the end portion 35 of spring contact 30 and the outer end of the plunger extend outwardly beyond the cover 19. When the plunger is moved axially inwardly, the end portion 35 of the spring contact 30 is flexed toward and into engagement with contact 32 to complete the circuit. When the plunger is released, the spring contact 30 returns to its free state condition of FIG. 3 spaced from contact 32. The schematic representation of the circuit 26 is shown in FIG. 5 where the switch 28 is connected in series with the alarm 20 and the battery 34. Thus, when the plunger is depressed to connect the contacts 30 and 32, the circuit is complete to connect the alarm 20 with the battery 34 to sound the alarm.

In use, when the user grabs the hand grip 14, the plunger 29 is normally depressed by the hand of the user to connect the contacts 30 and 32 and complete the circuit so that the audible alarm 20 is sounded to send a warning of impending use of the weapon.

Figure 6:
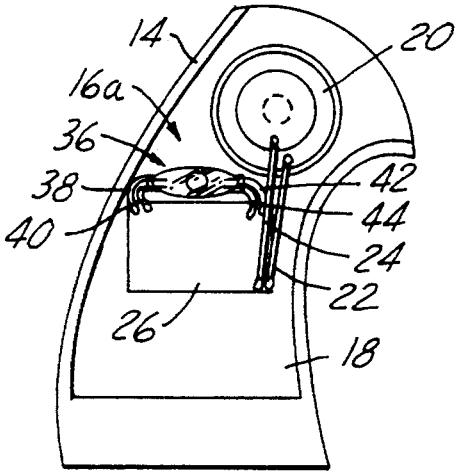
FIG. 6 is a side view of the hand of the weapon showing another embodiment of the invention with a cover removed for clarity.
Figure 7:
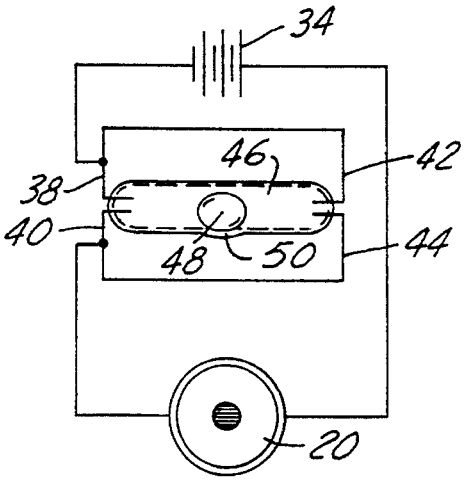
FIG. 7 is a schematic diagram of the electronic circuit of the embodiment of FIG. 6.

In another embodiment seen in FIGS. 6 and 7, a safety alarm system **16*a* is housed within the cavity 18 in the hand grip 14. A removable cover, similar to cover 19 described in connection with the first embodiment, closes the cavity, but has been removed from the illustration of FIG. 6 for the purpose of clarity. The switch 28 comprises a level switch such as, for example, a mercury switch 36 connected to the electric circuit 26 through wires 38, 40, 42, 44. The circuit for this embodiment can be seen clearly in FIG. 7 in which the mercury switch 36 generally comprises an elongated glass bulb 46 secured in fixed position within cavity 18 with spaced electrical contacts represented by wires 38 and 40 extending into one end of the tube and spaced electrical contacts represented by wires 42 and 44 extending into the opposite end. The bulb 46 has a droplet of electrically conductive liquid at 48 such as mercury which, when the tube is in a level position, rests in a recess or detent 50 in the bulb 46. When the bulb is tilted out of the horizontal position, the mercury 48 flows to either end of the bulb 46 to bridge the contacts 38 and 40 or 42 and 44 to electrically connect the alarm 22 to battery 34** and sound the alarm.

In use, the weapon is preferably stored in a position in which the mercury 48 rests in the recess 50 to keep the circuit open. When an unauthorized person such as a child handles the weapon and moves it so that the bulb 46 is out of the horizontal position, the mercury 48 flows to either end of the tube to complete the circuit and sound the alarm to warn of possible impending use.

I claim:

1. A safety alarm for a hand gun comprising:

a gun body having a hand grip, a cavity in said hand grip, a removable cover on said body closing said cavity, a battery mounted on said body within said cavity, an audible alarm mounted on said body within the cavity, an electric circuit connecting said alarm to said battery, a switch in said circuit having normally open switch contacts within said cavity, which, when closed, complete the circuit from said battery to said alarm to sound the alarm, one of said contacts being fixed within said cavity and the other of said contacts being in the form of a leaf spring having one end portion fixed within said cavity and the other end portion spaced from said one contact in the normal unstressed condition of said spring, and actuating means for closing said contacts, said actuating means comprising an elongated plunger having a first end secured to said other end portion of said leaf spring, an aperture in said cover, said plunger extending slidably through said aperture and having a second end projecting beyond said hand grip to a position adapted to be engaged and depressed by the hand of a person gripping the hand grip, thereby moving the plunger inwardly relative to said cavity and causing the said other end portion of said leaf spring to engage said one contact.

2. A safety alarm for a hand gun comprising a gun body having a hand grip, a cavity in said hand grip, a battery mounted on said gun body within said cavity, an audible alarm mounted on said body within the cavity, an electric circuit connecting said alarm to said battery, a switch in said circuit comprising an elongated tube affixed within said cavity, said tube having a first end and a second end and a longitudinal axis which is horizontal in a particular position of the hand gun, a drop of mercury in said tube, said switch having a first pair of spaced apart, normally open, switch contacts extending into the first end of said tube and a second pair of spaced apart, normally open, contacts extending into the second end of said tube, said drop of mercury being movable in said tube to one end thereof or the other to bridge said first or said second pair of contacts and close the circuit when said tube is oriented otherwise than horizontally during handling of the gun, said first or said second pair of contacts, when closed, completing the circuit from said battery to said alarm to sound the alarm, and a recess midway between the ends of said tube to receive the drop of mercury when the tube is horizontal.

* * * * *